US007445395B2

(12) United States Patent
Yu

(10) Patent No.: US 7,445,395 B2
(45) Date of Patent: Nov. 4, 2008

(54) UNINTERRUPTED INK MARKER

(76) Inventor: Kai-Lo Yu, 5F, No. 12, Alley 8, Lane 221, Sec. 3, Singlong Rd., Wunshan District, Taipei City 116 (TW)

( * ) Notice: Subject to any disclaimer, the term of this patent is extended or adjusted under 35 U.S.C. 154(b) by 292 days.

(21) Appl. No.: 11/244,229

(22) Filed: Oct. 6, 2005

(65) Prior Publication Data

US 2007/0081849 A1 Apr. 12, 2007

(51) Int. Cl.
*B43K 5/00* (2006.01)

(52) U.S. Cl. ..... 401/198

(58) Field of Classification Search ..... 401/195, 401/196, 198

See application file for complete search history.

(56) References Cited

U.S. PATENT DOCUMENTS 4,017,871 A * 4/1977 Hubbard ..... 346/140.1
5,033,896 A * 7/1991 Lytle et al. ..... 401/192

* cited by examiner

*Primary Examiner*—Huyen Le
(74) *Attorney, Agent, or Firm*—Rosenberg, Klein & Lee

(57) ABSTRACT

An uninterrupted ink marker, which includes a base tube, a vertical tube, a refill head and a cap, is disclosed. The base tube includes an inner space, a base section and a bent section. The bent section is curvedly extended from the base section, and the base section has an open end to contain the refill head. The vertical tube, which has an inner space and a bottom end, is connected to the base tube on the bottom end and substantially vertical to the base section of the base tube. The cap has at least one U recessed portion for replacing to the refill head.

9 Claims, 9 Drawing Sheets

UNINTERRUPTED INK MARKER

FIELD OF THE INVENTION

The present invention relates to an ink marker, and more particularly to an ink marker with a vertical tube vertical to a refill head of the ink marker to keep ink providing smoothly without interruption.

BACKGROUND OF THE INVENTION

Nowadays in our daily life, it is almost unavoidable for everyone to use marking instrument for writing affairs down, drawing figures, recording notations, or marking symbols, etc. However, for the most people, what they feel bored and inconvenient most is ink provision of the ink marking instruments is not steady.

Furthermore, it will make troubles or embarrassments to people when they do a presentation, a seminar or a speech if some of the words, symbols or figures they marked on board are dark enough, but others are too shallow to be identified by the attendances. Especially when the key words, symbols or figures needed to be present clearly are not clear enough to be identified, the efficiency of the presentation, seminar or speech will fall down apparently.

According to the gravity principle, ink within a marking instrument flows down from a high position to a low position, and the flow rate of ink flowing is proportional to the height deviation from the start to the destination of flowing. In the present, when a person naturally uses an ink marker to write words on a board, such as a white board, with a elevation angle approximate to 90 degree, the board is almost vertical to the ground level, the ink marker is approximately horizontal to the ground level, and the height deviation from the start to the destination of ink flowing is approximate to zero. Even more, the head of the marker may lift up and the tail of the marker may lie down when somebody uses the ink marker, and the height deviation from the start to the destination of ink flowing may be minus in this moment. So, the rate of ink flowing or provision will be apparently decreased approximate to zero, even zero, depending on the relation of the capillarity effect within a refill of the ink marker and the angle between the ink marker and the ground level.

Besides, another problem around current markers, the short life of refills and refill heads, is also existed for a long time. Especially, people usually push or pull markers hard when its color becoming shallower, this is the reason to distort or even to destroy the refill head.

SUMMARY OF THE INVENTION

Since the existed disadvantages of the traditional ink marker as we known as above have brought many inconveniences and troubles for many people in daily life, it will be more necessary for us to search for some method to solve these problems. Under the situation as above description, a primary object of the present invention is to provide an ink marker with uninterrupted characteristics when people use the ink marker to mark words, figures or symbols, etc. on a board or a objection approximately vertical to ground level through the improvement of the ink marker construction.

The uninterrupted ink marker is mainly composed of a base tube, a vertical tube, a refill and a refill head. The base tube includes an inner space, a base section and a bent section. The bent section is curvedly extended from the base section, and the base section has an opening end to contain the refill head. The vertical tube, which has an inner space, a top end and a bottom end, is connected to the base tube on the bottom end and straightly vertical to the base section of the base tube. The refill for storing and providing ink is fitted in the inner space of the vertical tube, extended to the inner space of the base tube and connected to the refill head.

Besides, the uninterrupted ink marker further includes a pivotal mechanism an arc board and a cap. The pivotal mechanism is fitted on the bent section of the base tube near the bottom end of the vertical tube. The arc board is connected with the pivotal mechanism to make the arc board becoming foldable for the vertical tube and has an inner arc surface fit for the vertical tube. By the way, when the arc board is spread out from the vertical tube in a direction parallel to the base tube, the cap can be stuck in the inner arc surface of the arc board extremely near the bent section of the base tube to form a gripping portion of the uninterrupted marker for a user, i.e., the integral appearance of the uninterrupted ink marker is presented as a "reverse T" in this moment.

Furthermore, linking by the thought as previous mentioned, there is no mechanism or design so far to replace the refills and the refill heads, so the secondary object of the present invention is to provide an ink marker with a mechanism design for refill replacement.

To solve the problems of refill head replacement, the design in this invention is providing a cover with a U recessed portion for making easeful replacement of the refill head. The cover is actually the tool to change the refill head, people can just place the refill head into the U recessed portion and turn it along a counterclockwise direction, pull it out when it becomes loosen, and fit the spared refill head into the opening end of the base section of the base tube by turning it along the clockwise direction.

According to the constructions as above description, when a person use the uninterrupted ink marker to mark words, figures, or symbols, etc. on the board or the objection approximately vertical to ground level, an ink provision element, i.e. the refill, will be almost vertical to the ground level. In this situation, ink flow from the refill to the refill head will be very smoothly due to the height deviation between the refill and refill head is sufficient for ink flowing down. Besides, the refill replacement will be easier through the way of using the cover with the U recessed portion.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The construction, devices, characteristics and the best embodiment of this invention are described with relative figures as follows.

Figure 1:
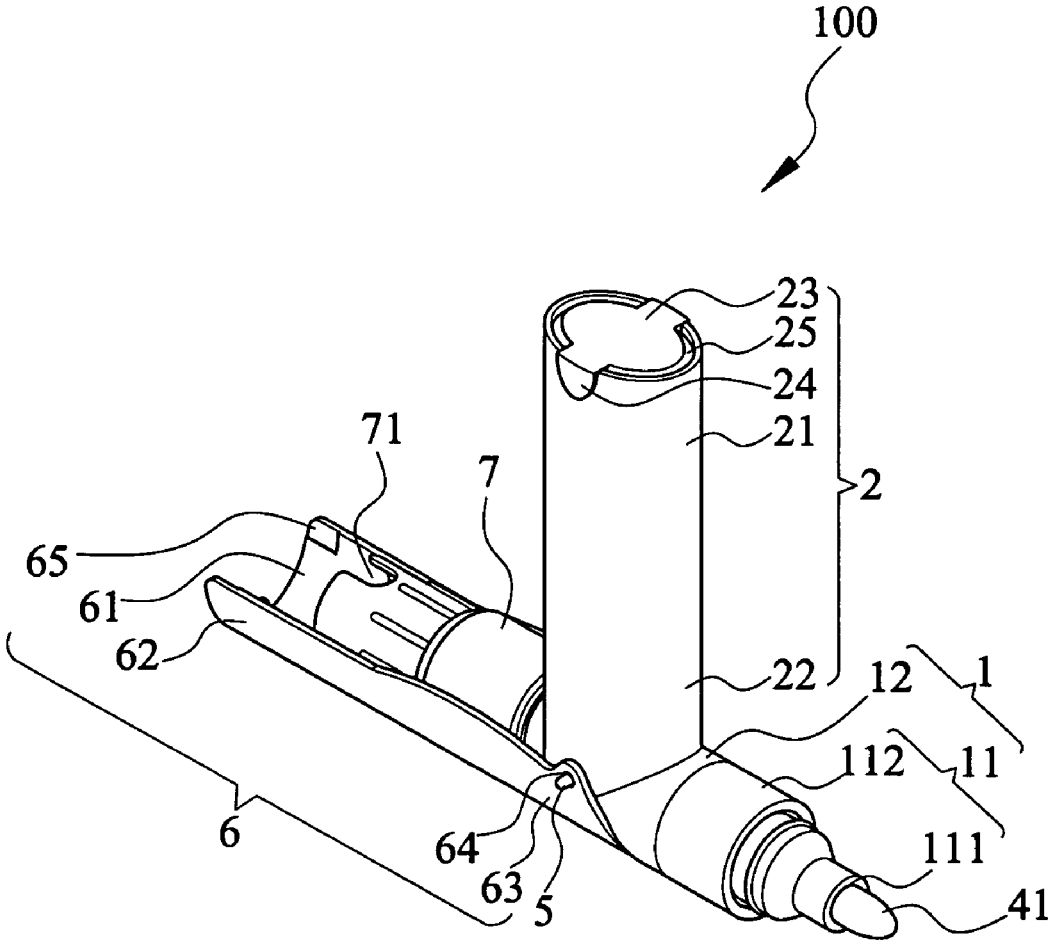
FIG. 1 is a perspective view of an uninterrupted ink marker in accordance with a best embodiment of the present invention.
Figure 2:
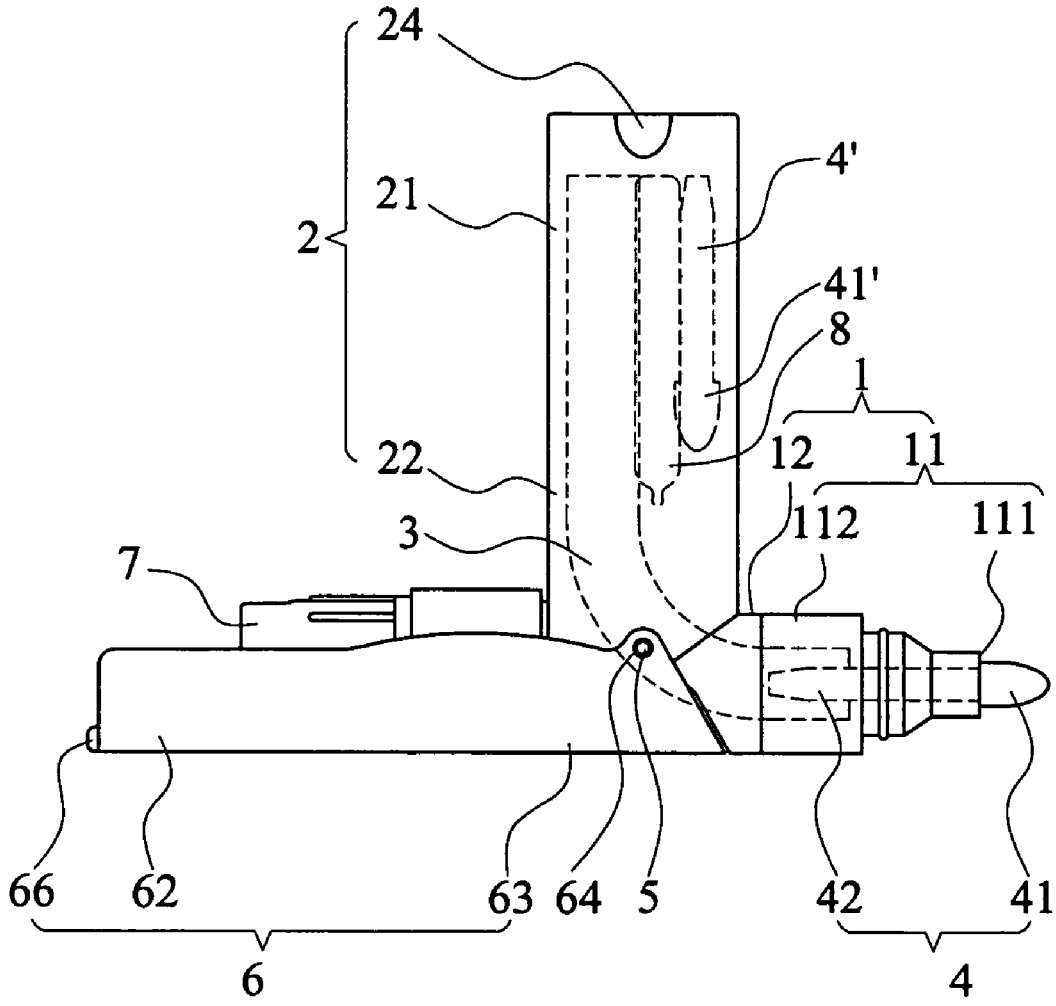
FIG. 2 is a side view of the uninterrupted ink marker in accordance with the best embodiment of the present invention.
Figure 3:
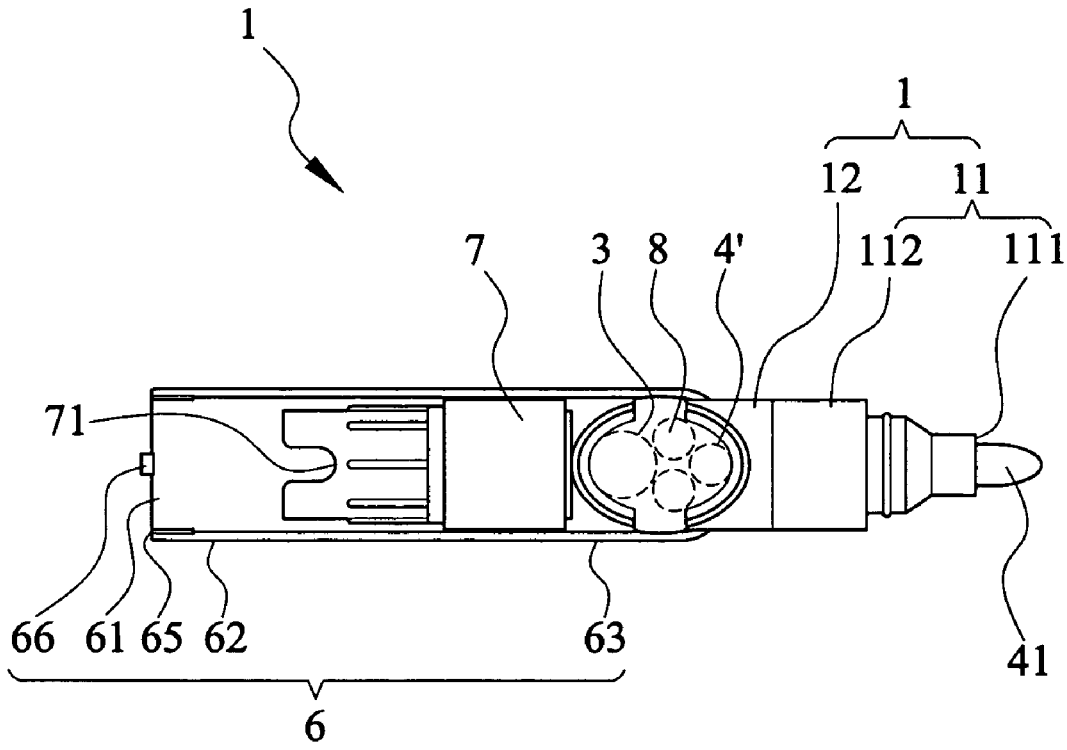
FIG. 3 is a top view of the uninterrupted ink marker in accordance to the best embodiment of the present invention.

Please refer to FIG. 1 to FIG. 3. An uninterrupted ink marker 100 in accordance with the best embodiment of this invention comprises a base tube 1, a vertical tube 2, a refill 3, a refill head 4, a cap 5, a pivotal mechanism 6 and an arc board 7. The base tube 1 has an inner space and includes a base section 11 and a bent section 12. The base section 11 has an opening end 111 to contain the refill head 4 and a connecting end 112. The bent section 12 is extended from the connecting end 112 of base section 11. As we all know, the bent section 12 can be formed in a curved or rectangular bending appearance.

The vertical tube 2 has an inner space and includes a top end 21, a bottom end 22, a plug 23 and a pair of extrusive portion 24. The bottom end 22 is connected to the base tube 1 and makes the vertical tube 2 vertical to the base section 11 of the base tube 1. The plug 23 is inserted into the top end 21 of the vertical tube 2, and the extrusive portion 24 is sideward extruded from the vertical tube 2. By the way, a plug gap 25 is naturally formed between the plug 23 and the top end 21 of the vertical tube 2.

The refill 3 is used for storing and providing ink, and it is fitted in the inner space of the vertical tube 2 and extended to the inner space of the base tube 1. The refill head 4 includes a marking portion 41 and a refill portion 42. When the refill 42 is fitted into the opening end 111 of base tube 1, the marking portion 41 is exposed from the opening end 111 and the refill portion 42 is connected to the refill 3.

According to above description, people those skilled in this art will easily realize that the uninterrupted ink marker 100 will perform good efficiency in ink provision due to the reason as the following statement. When a person naturally uses the ink uninterrupted marker 100 to write words on a board, such as a white board, with a elevation angle approximate to 90 degree, the board is almost vertical to the ground level. Although the base tube 1 is approximately horizontal to the ground level in this moment, the vertical tube 2 still keep in a direction almost vertical to the ground level. The height deviation from the start to the destination of ink flowing is still sufficient to drive ink flowing along the refill 3 and providing to the refill head 4.

The pivotal mechanism 5 is located on the bent section 12 of the base tube 1 near the bottom end 11 of the vertical tube. The arc board 6 includes an inner arc surface 61, a top portion 62 and a bottom portion 63. The inner arc surface 61 is fit for the vertical tube 2. The bottom portion 63 has a pair of connection holes 64 respective to the pivotal mechanism 5 in order to connect the arc board 6 to the pivotal mechanism 5 and make the arc board 6 foldable for the vertical tube 2. The top portion 62 of the arc board 6 has a pair of recessed cave 65 and a hooked portion 66 on the inner arc surface 61. The recessed cave 65 has a dimension respective to the extrusive portion 24 of the plug 23 in order to fit with the extrusive portion 24 of the plug 23. The hooked part 66 is located respective to the plug gap 25 in order to lock the arc board to the plug gap 25.

As we all know, in the best embodiment of this invention, the pivotal mechanism 5 is a pair of exposed pins; however, the pivotal mechanism 5 can be any kind of members having the capacity to make the arc board 6 foldable for the vertical tube 2 as known by people those skilled in this art.

The cap 7 is used to cover the refill head 4 and a pair of U recessed portion 71. When the arc board 6 is spread out from the vertical tube 2 in a direction parallel to the base tube 2, the cap 7 can be stuck in the inner arc surface 61 of the arc board 6 extremely near the bent section 12 of the base tube 1 to form a gripping portion of the uninterrupted marker 100 for a user, i.e., the integral appearance of the uninterrupted ink marker is presented as a "reverse T" in this moment herein we view it as "normal use situation".

In the best embodiment of this invention, the cap 7 has an opening end and a closed end. The opening is used to cover the refill head 4, and the U recessed portion 71 is located on the closed end. Besides, for the purpose of preparing spared part of the elements may be exhausted under the normal use situation, the uninterrupted ink marker 100 further includes at least one ink-refill tube 8 and one spared refill head 4' within the vertical tube.

Figure 4:
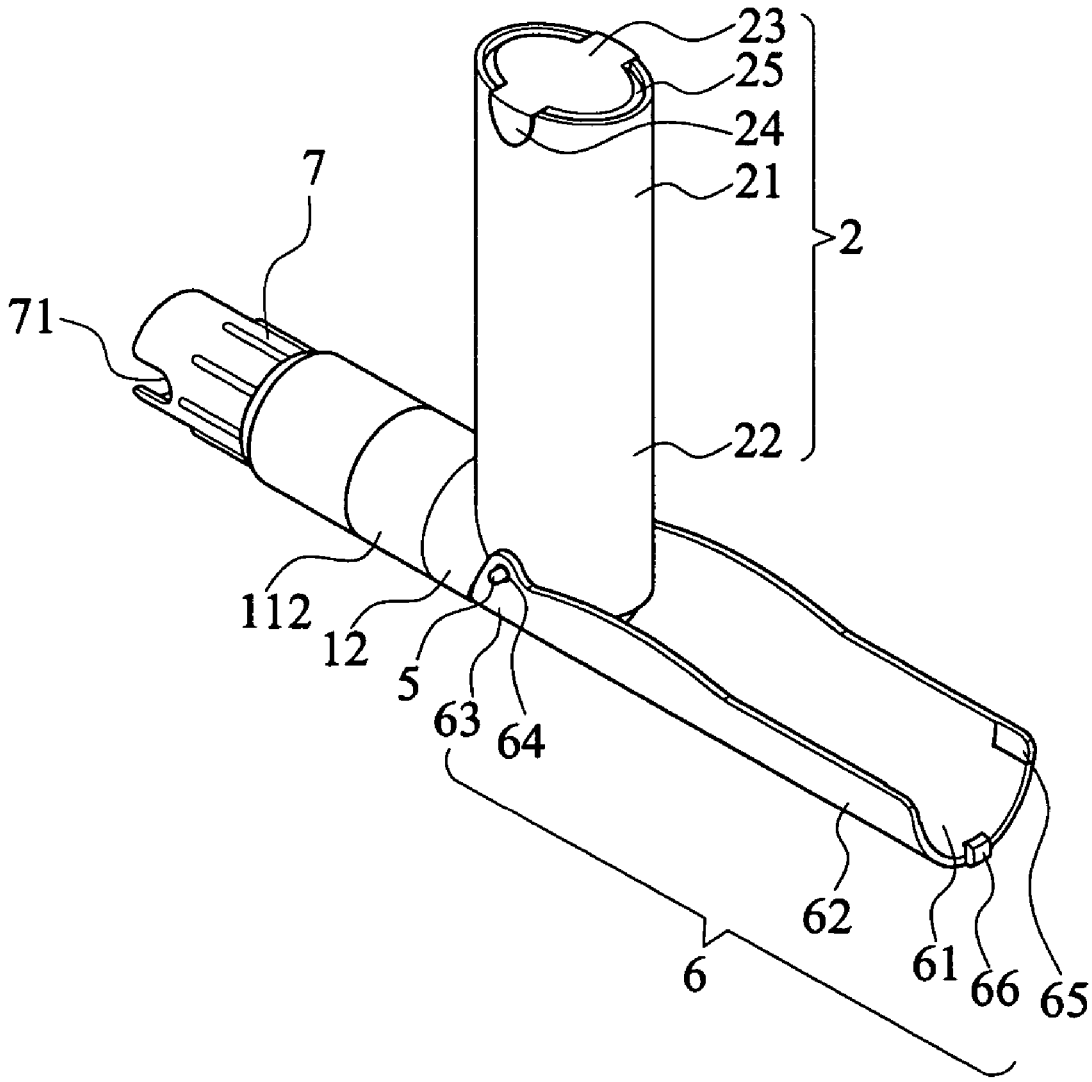
FIG. 4 is a perspective view of an uninterrupted ink marker showing the first step to transfer the uninterrupted ink mark to a general situation.
Figure 5:
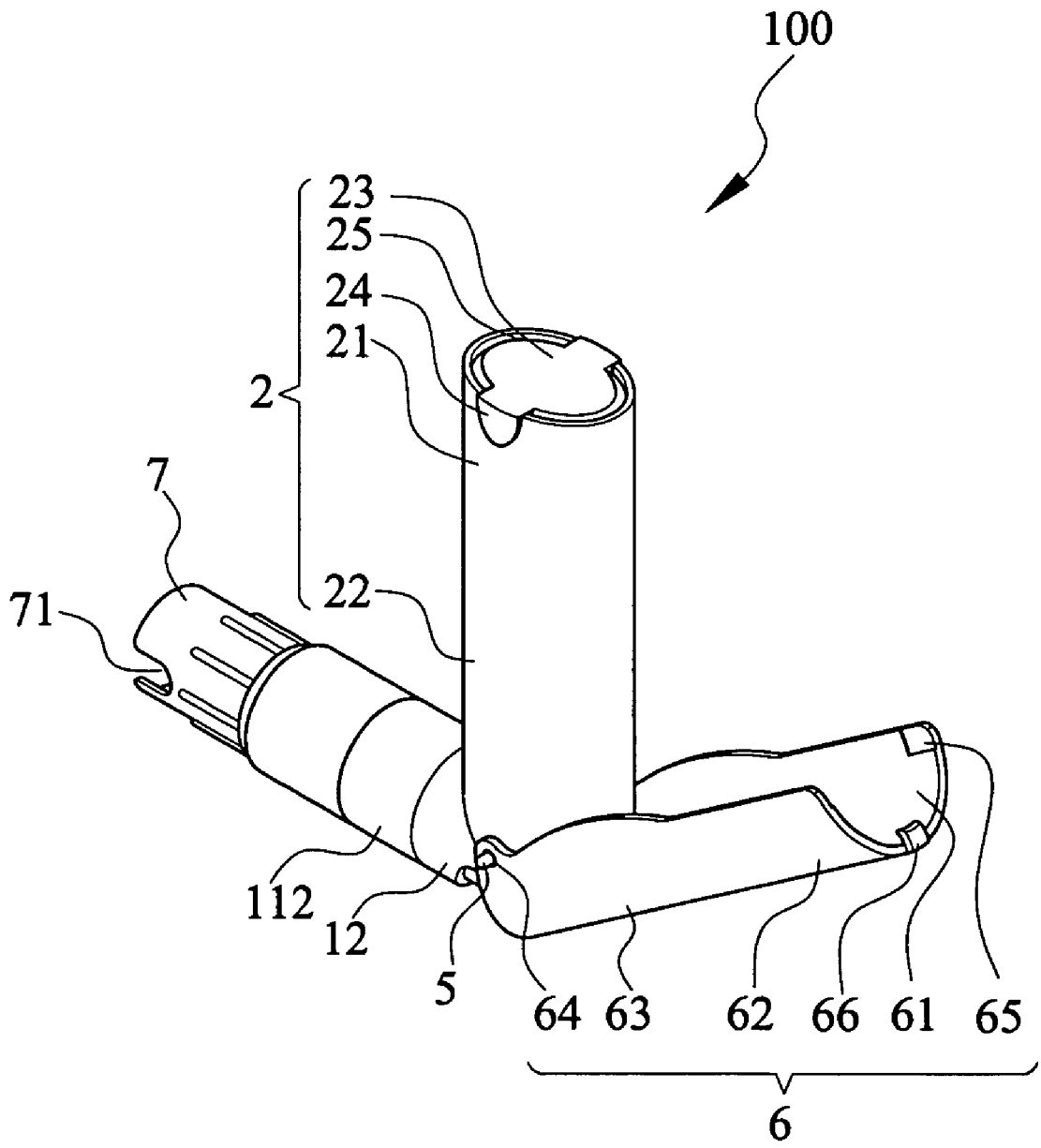
FIG. 5 is a perspective view of an uninterrupted ink marker showing the second step to transfer the uninterrupted ink mark to the general situation.
Figure 6:
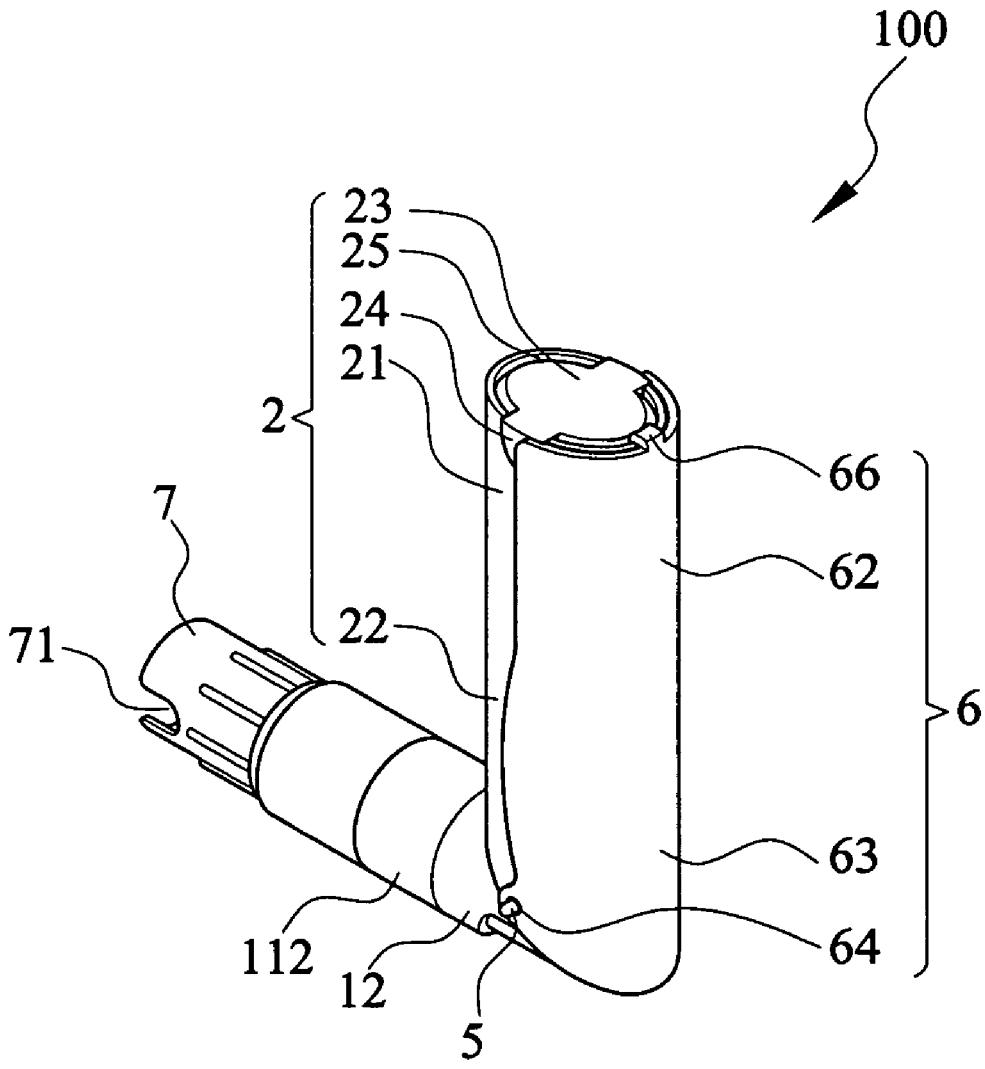
FIG. 6 is a perspective view of an uninterrupted ink marker showing the third step to transfer the uninterrupted ink mark to the general situation.

Please refer to FIG. 4 to FIG. 6, which present a series procedure of the uninterrupted ink marker 100 folded and fitted on the vertical cap 2 to transfer to a general situation. As shown in FIG. 4, the first step is drawing the cap 7 out of the inner arc surface 61 of the arc board 6 and fitting it on the base tube to cover the marking portion 41 of the refill head 4. Further referring to FIG. 5, the second step is pushing the arc board 6 on a surface opposite to the inner arc surface 61 and folding the arc board 6 toward the vertical tube 2. Continuously referring to FIG. 6, the third step is fitting the whole arc board on the vertical tube 2 via the dimension fitting between the relative elements, such as extrusive portion 24 of the vertical tube 2, the recessed cave 65 of the arc board 2, the plug gap 25 of the vertical tube 2 and the hooked portion 66 of the arc board 6, the uninterrupted ink marker now transfers to the general situation. As we all know, we just need to do all things reversed to the above series procedure when we need to use the uninterrupted ink marker in the normal use situation.

Figure 7:
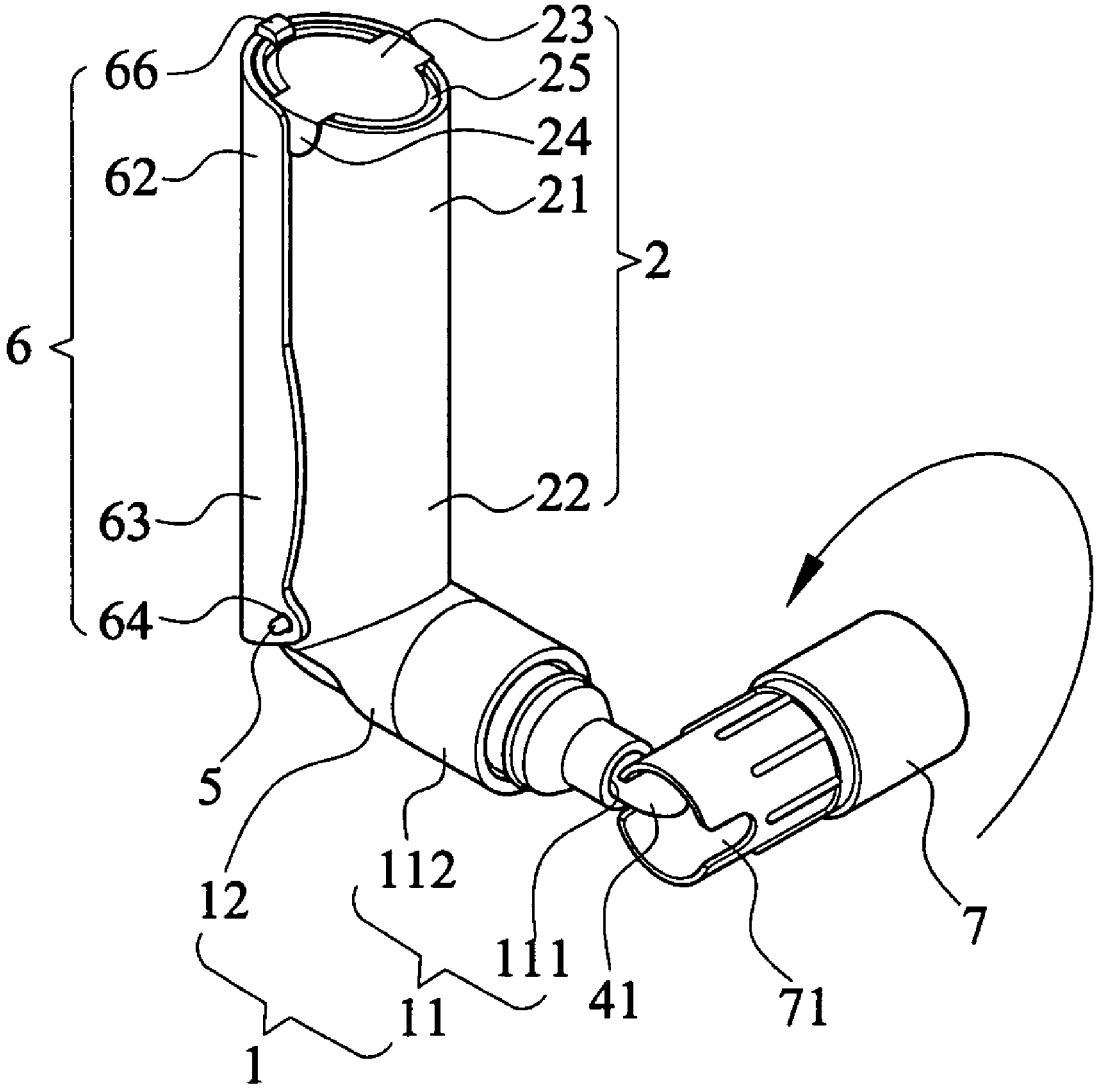
FIG. 7 is a perspective view showing the first step and the second of the replacement of the refill head.
Figure 8:
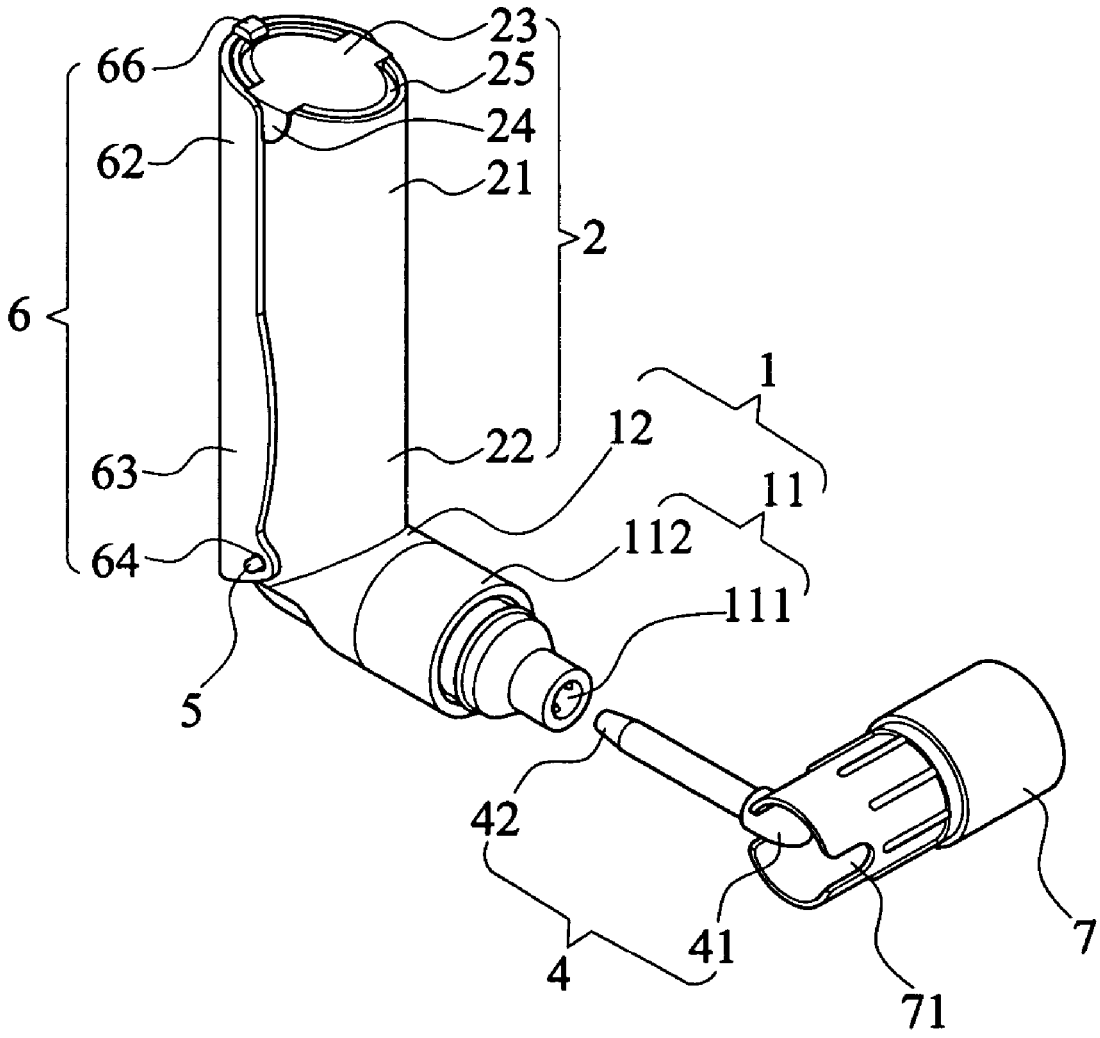
FIG. 8 is a perspective view showing the third step of the replacement of the refill head.

With reference to FIG. 7 and FIG. 8, which present a series procedure of the replacement of the refill head 4. As shown in FIG. 7, the first step is inserting the refill head 4 of the uninterrupted ink marker 100 to the U recessed portion 71 of the cap 7. The second step is turning the cap 7 along a specified releasing direction, and the turning direction in the best embodiment of the invention is counterclockwise direction. As shown in FIG. 8, the third step is pulling the refill head 4 out of the opening end 111 of the base tube 1 when the refill head 4 becomes loosen relative to the base tube 1. The fourth step is removing the plug 23 from the vertical tube 2, taking the spared refill head 4' from the vertical tube, and inserting the spared refill head 4' into the opening end 111 of the base tube 1. The rest steps to fit the spared refill head 4' into the opening end of the base tube 1 are reversed to the first step and the second step.

Figure 9:
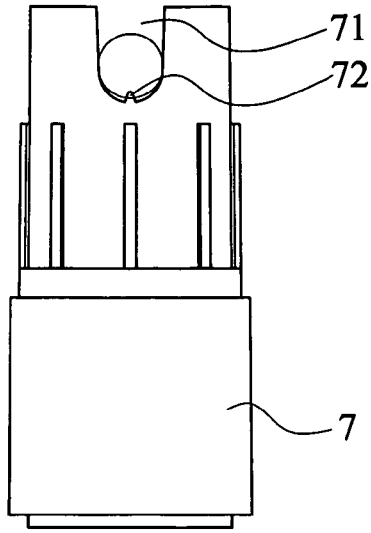
FIG. 9 is a side view showing a U recessed portion with a tooth-alike extrusion can remove the refill head.
Figure 10:
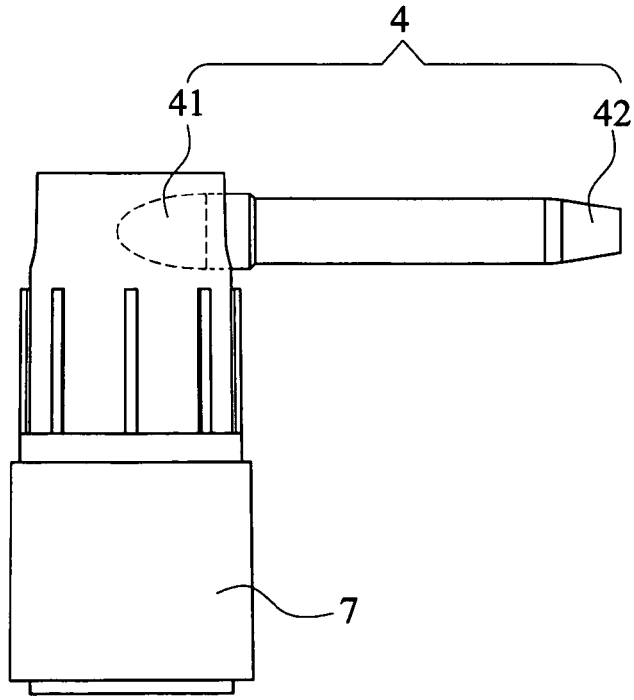
FIG. 10 is another side view showing a U recessed portion with a tooth-alike extrusion can remove the refill head.

In order to ensure the cap 7 to have sufficient capacity to replace different types of the refill head 4, as shown in FIG. 9 and FIG. 10, a tooth-alike extrusion 72 can be extruded from the center of the U recessed portion 71 to strengthen the holding ability of the cap related to the refill head 4.

People those skilled in this art can easily realize the relative spare elements, such as the spared refill 8 and the spared refill head 4' will bring much convenience to the users when the uninterrupted ink marker 100 is lacking of ink. More importantly, it provides a proper replacement method to prolong the life of the refill head 4.

To make a summary, the uninterrupted ink marker in accordance with the present invention not only has solved the existed problems effectively but also brings novel, practicable and progressive value meeting the essence of patent to be applied for.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An uninterrupted ink marker, comprising:

a base tube with an inner space and including:

a base section with an open end and a connecting end;

a marking portion extended out from the open end; and a bent section extended from the connecting end of the base section;

a refill head mounted on the open end of the base section and extended into the inner space of the base tube;

a vertical tube with an inner space, a top end and a bottom end connected to the bent section of the base tube and substantially vertical to the base section of the base tube;

a pivotal mechanism being located on the connecting end of the bent section of the base tube near the bottom end of the vertical tube, an arc board being connected to the base tube through the pivotal mechanism, the arc board including:

an inner arc surface fit for the vertical tube;

a top portion; and, a bottom portion connected with the pivotal mechanism for making the arc board foldable to the vertical tube; and a refill fitted in the inner space of the vertical tube and extended to the inner space of the base tube for storing a mount of ink and providing the ink to the refill head, the refill being disposed above and directed angularly upwardly with respect to the marking portion.

2. The uninterrupted ink marker as claimed in claim 1, further comprising a cap adapted to cover the open end of the base section of the base tube and alternatively sticking in the inner arc surface of the arc board to form a gripping portion of the uninterrupted marker as the arc board spreading out from the vertical tube in a direction parallel to the base tube.

3. The uninterrupted ink marker as claimed in claim 2, wherein the cap further includes at least one U recessed portion for replacing the refill head from the open end of the base tube.

4. The uninterrupted ink marker as claimed in claim 1, further comprising at least one spared refill head within the vertical tube.

5. The uninterrupted ink marker as claimed in claim 1, wherein the pivotal mechanism is provided with a pair of exposed pins and the arc board is connected with the exposed pins via a pair of connection holes located near the bottom portion of the arc board.

6. The uninterrupted ink marker, comprising:

a base tube with an inner space and including:

a base section with an open end and a connecting end; and a bent section extended from the connecting end of the base section;

a refill head mounted on the open end of the base section and extended into the inner space of the base tube;

a vertical tube with an inner space, a top end and a bottom end connected to the bent section of the base tube and substantially vertical to the base section of the base tube; and a refill fitted in the inner space of the vertical tube and extended to the inner space of the base tube for storing a mount of ink and providing the ink to the refill head, wherein the top end of the vertical tube is inserted with a plug which has at least one extrusive portion sideward extruded from the vertical tube and a plug gap between the plug and the top end of the vertical tube.

7. The uninterrupted ink marker as claimed in claim 6, wherein the top portion of the arc board further includes at least one recessed cave on the inner arc surface respective to the extrusive portion of the plug for fitting with the extrusive portion of the plug.

8. The uninterrupted ink marker as claimed in claim 6, wherein the top portion of the arc board further includes at least one hooked portion on the inner surface respective to the plug gap for locking the arc board to the plug gap.

9. The uninterrupted ink marker comprising: a base tube with an inner space and including:

a base section with an open end and a connecting end; and a bent section extended from the connecting end of the base section;

a refill head mounted on the open end of the base section and extended into the inner space of the base tube;

a vertical tube with an inner space, a top end and a bottom end connected to the bent section of the base tube and substantially vertical to the base section of the base tube, at least one spared ink-refill tube within the vertical tube; and a refill fitted in the inner space of the vertical tube and extended to the inner space of the base tube for storing a mount of ink and providing the ink to the refill head.

* * * * *